US009310153B2

(12) United States Patent
Nettleton et al.

(10) Patent No.: US 9,310,153 B2
(45) Date of Patent: Apr. 12, 2016

(54) CROSSBOW KICKSTAND

(71) Applicants: Philip D. Nettleton, Wichita, KS (US); Jeremy E. Weinman, Derby, KS (US)

(72) Inventors: Philip D. Nettleton, Wichita, KS (US); Jeremy E. Weinman, Derby, KS (US)

( * ) Notice: Subject to any disclaimer, the term of this patent is extended or adjusted under 35 U.S.C. 154(b) by 0 days.

(21) Appl. No.: 14/834,103

(22) Filed: Aug. 24, 2015

(65) Prior Publication Data

US 2016/0054090 A1 Feb. 25, 2016

Related U.S. Application Data

(60) Provisional application No. 62/040,833, filed on Aug. 22, 2014.

(51) Int. Cl.
*F41B 5/12* (2006.01)
*F41A 23/10* (2006.01)

(52) U.S. Cl.
CPC .. *F41A 23/10* (2013.01); *F41B 5/12* (2013.01)

(58) Field of Classification Search
CPC ..... F41B 5/12; F41B 5/14
See application file for complete search history.

(56) References Cited

U.S. PATENT DOCUMENTS 3,256,872 A * 6/1966 Koser ..... F41B 5/14 124/23.1
4,360,179 A * 11/1982 Roberts ..... F41B 5/14 124/23.1
5,106,044 A * 4/1992 Regard, III ..... F41B 5/14 124/23.1
6,032,911 A * 3/2000 Osborne ..... F41A 23/18 248/229.15
7,958,878 B2 * 6/2011 Hoffmann ..... A01M 31/025 124/25
7,997,258 B2 8/2011 Shepley et al.
8,161,956 B2 4/2012 Bednar
8,622,050 B2 1/2014 Goff et al.
8,671,923 B2 3/2014 Goff et al.
8,763,598 B1 * 7/2014 MacLeod ..... F41B 5/1484 124/1
9,097,499 B2 * 8/2015 Goehring, III ..... F41B 5/0094

OTHER PUBLICATIONS

Outdoors Experience, "LP Archery Pro Folding Kickstand", www.outdoorsexperience.com/propod.html, 2014, 1-2.

* cited by examiner

*Primary Examiner* — John Ricci
(74) *Attorney, Agent, or Firm* — Law Office of Mark Brown, LLC; Christopher M. DeBacker

(57) ABSTRACT

A crossbow kickstand accessory which may be affixed beneath a crossbow stock. The kickstand has three positions: (1) a stored position; (2) a kickstand position; and (3) a bipod position. The kickstand position is at approximately a 40 degree angle, and the bipod position is at approximately a 90 degree angle away from the stock of the crossbow. The kickstand position allows the user to set the crossbow down while the stock is in the air making it simple to set down or pick up with only one hand. While the kickstand is open in the kickstand position, it prevents any twisting or rotation of the stand or the crossbow, which will prevent the crossbow from falling over. An alternative embodiment design would move the stand forward along the stock into the stock handle position.

15 Claims, 11 Drawing Sheets

CROSSBOW KICKSTAND

CROSS REFERENCE TO RELATED APPLICATION

This application claims priority in U.S. Provisional Patent Application No. 62/040,833, filed Aug. 22, 2014, which is incorporated herein by reference.

BACKGROUND OF THE INVENTION

1. Field of the Invention

The present invention relates generally to a crossbow kickstand, and more specifically to a crossbow kickstand accessory which may optionally be mounted to a crossbow for stability and ease of use.

2. Description of the Related Art

Due to new changes in regulations, the use of crossbows for hunting has become more popular and prolific in the hunting community. However, typical crossbows have a number of comfort and performance issues that need to be addressed to improve crossbow functionality. Typical crossbows either must be held aloft using the user's arms alone, or by propping the fore-end of the crossbow against a branch or other imperfect, non-portable structure.

Heretofore there has not been available a crossbow kickstand system or method of use with the advantages and features of the present invention.

SUMMARY OF THE INVENTION

The present invention generally provides a crossbow kickstand accessory which may be affixed beneath a crossbow stock. The kickstand has three positions: (1) a stored position; (2) a kickstand position; and (3) a bipod position. The kickstand position is at approximately a 40 degree angle, and the bipod position is at approximately a 90 degree angle away from the stock of the crossbow.

The kickstand position allows the user to set the crossbow down while the stock is in the air making it simple to set down or pick up with only one hand. The stand opens to the kickstand position by touching one or both kickstand legs on the ground and using the ground to help force open the legs of the stand from the stored position by pushing the crossbow forward and downward so the frictional force against the ground forces the stand to swing open into the kickstand position. The stand then moves into and remains in the kickstand position. While the kickstand is open in the kickstand position, it prevents any twisting or rotation of the stand or the crossbow, which will prevent the crossbow from falling over.

When the stand is transformed to the bipod position, it then will allow for a twisting or rotation movement used to track a target. To unlock the stand from the kickstand position to the bipod position, a finger tap or release button is activated which moves the lock piece away, allowing further rotation of the stand into the bipod position. The stand then may lock into the bipod position until released.

The stand may optionally include a receiver for an arrow or bolt quiver.

An alternative embodiment design would move the stand forward along the stock into the stock handle position. This configuration would be beneficial on different crossbow types and sizes. For example, on longer crossbows it is ideal to place the stand further away from the front of the crossbow and closer to the midway of the crossbow. This prevents the crossbow from falling over when the stand is in a kickstand position. This design would also allow for the stand to be moved forward or backwards along the stock because the forward stock handle can be moved along a rail located beneath the crossbow stock. This configuration could be with or without springs and could be locked from one position to the next using a push lever or push button.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
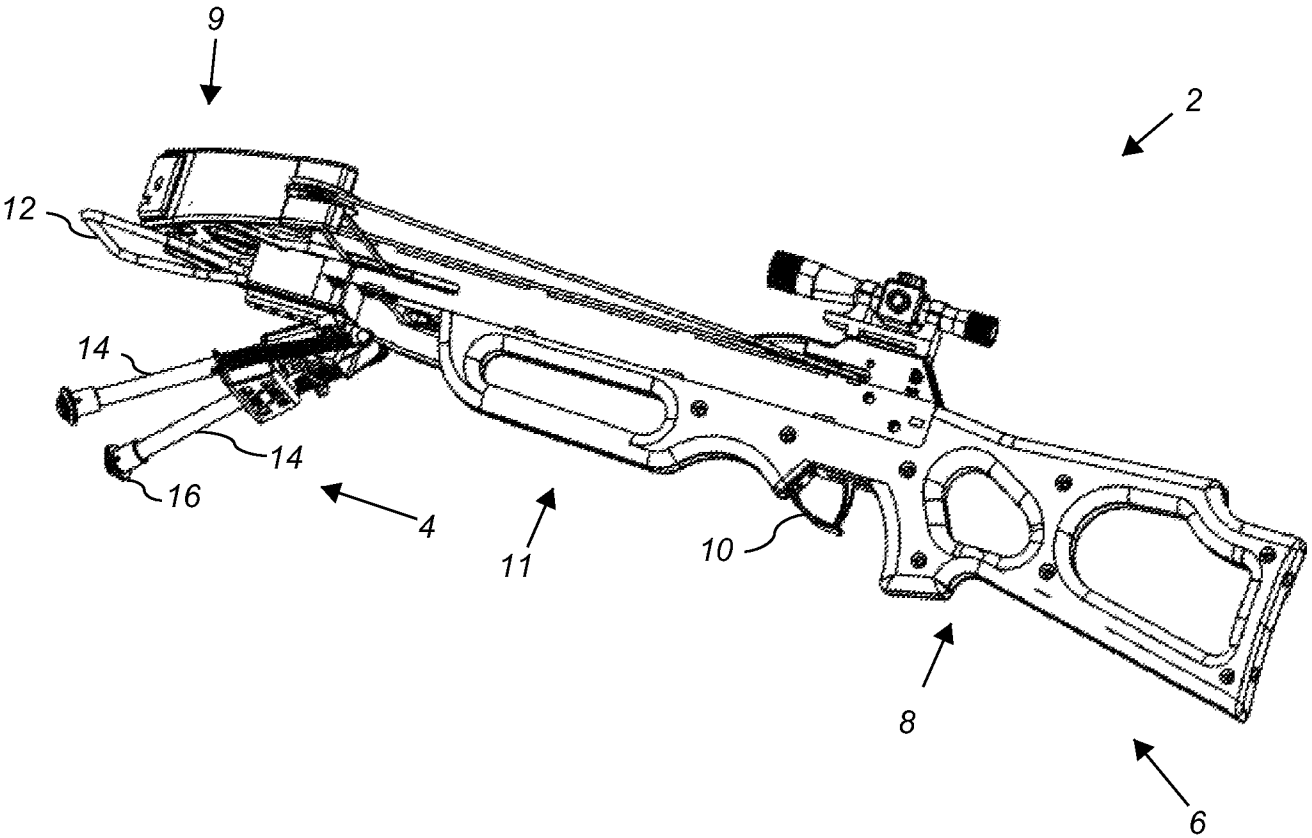
FIG. 1 is an isometric view of a preferred embodiment of the present invention in a typical environment affixed to a crossbow and placed in a kickstand position.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

Standard terminology used in the hunting or sporting industries may also be employed throughout. The terms "arrow" and "bolt" shall be used interchangeably to refer to ammunition for a crossbow.

II. Preferred Embodiment Crossbow Assembly 2

Referring to the figures in more detail, FIGS. 1-7C show the preferred embodiment of the present invention in its typical environment affixed to a crossbow 2. The kickstand 4 is mounted underneath the limbs 9 and riser, just forward from the foregrip 11, and in proximity with the stirrup 12. The crossbow also includes a rear grip 8 in proximity with the trigger 10 and a stock 6.

Figure 2:
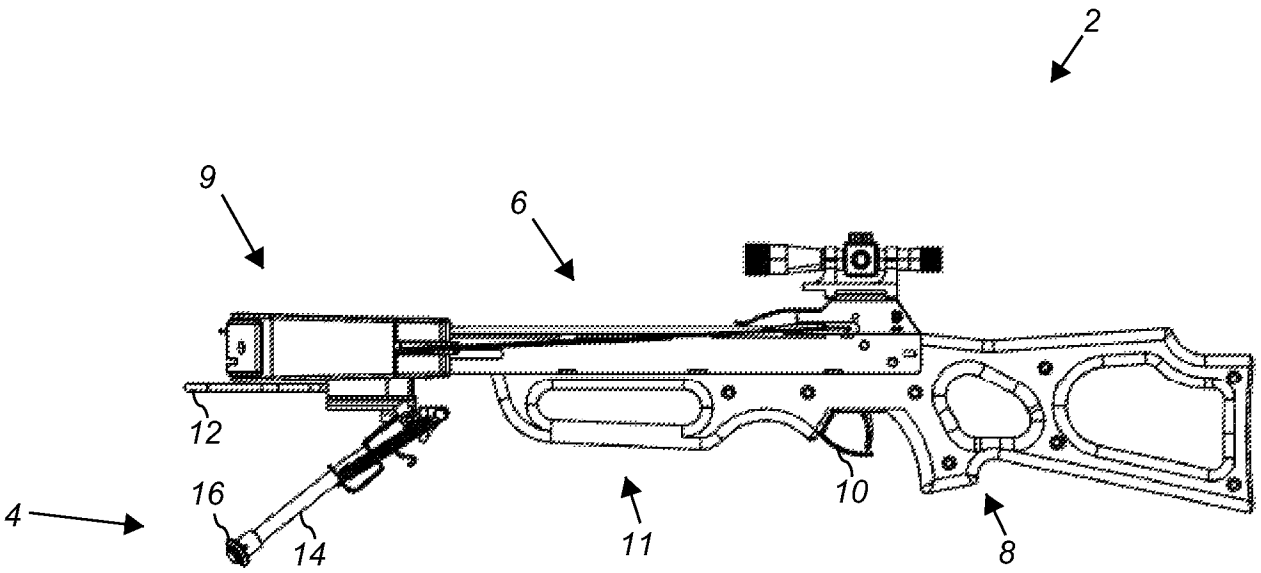
FIG. 2 is a side elevational view thereof.
Figure 3:
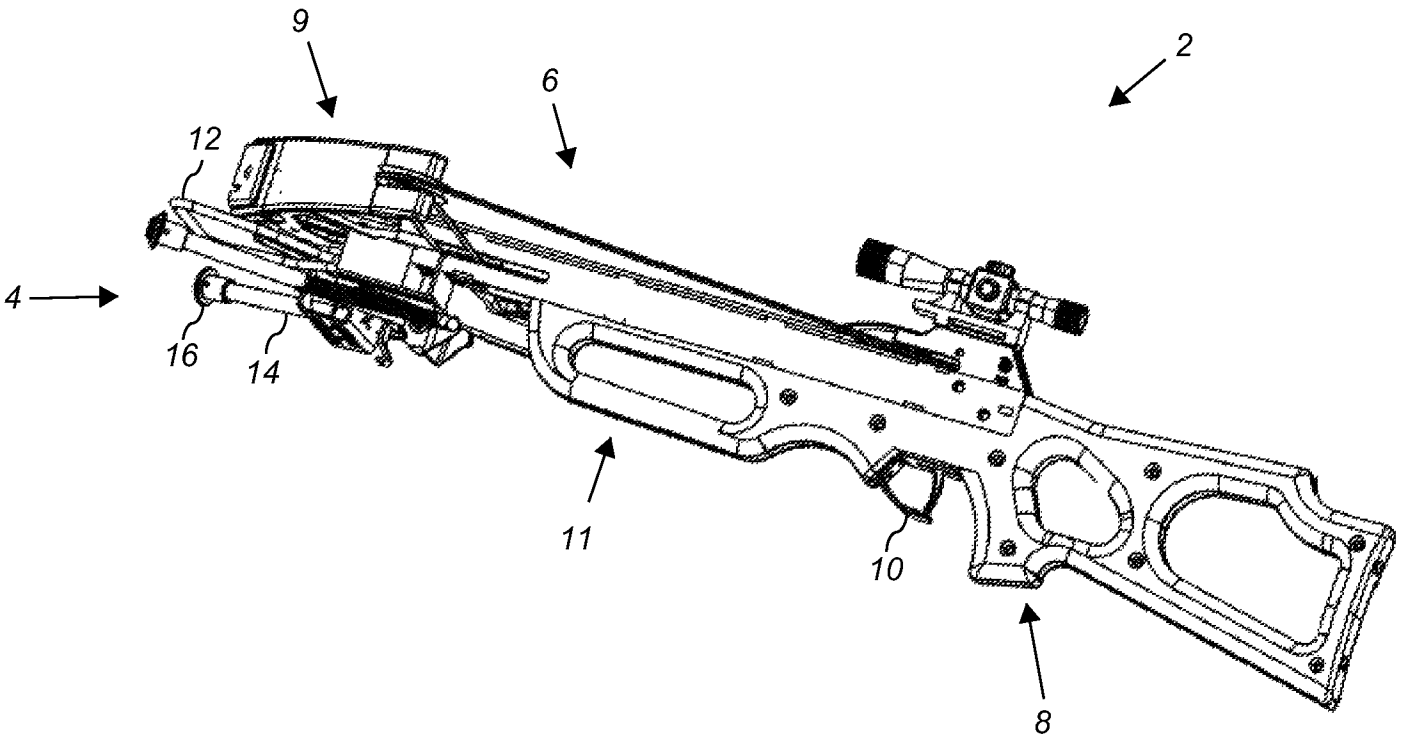
FIG. 3 is an isometric view of the preferred embodiment of the present invention of FIG. 1 showing a closed and stored position.
Figure 4:
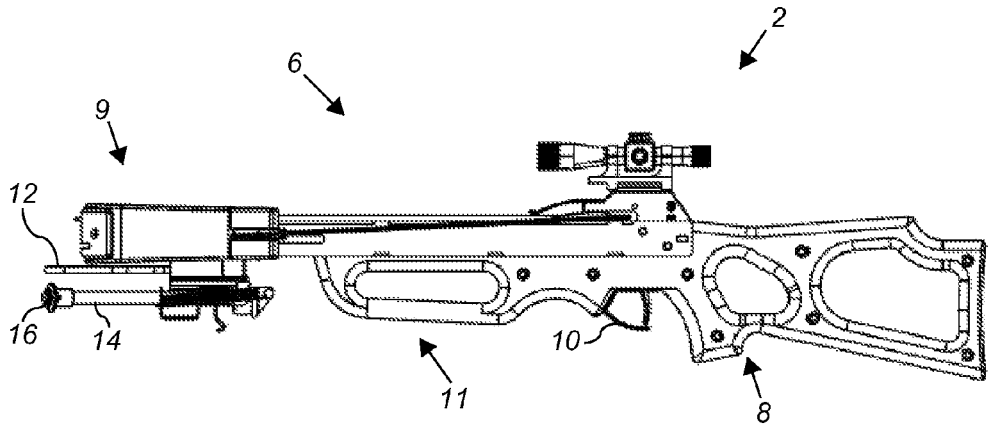
FIG. 4 is a side elevational view thereof.
Figure 5:
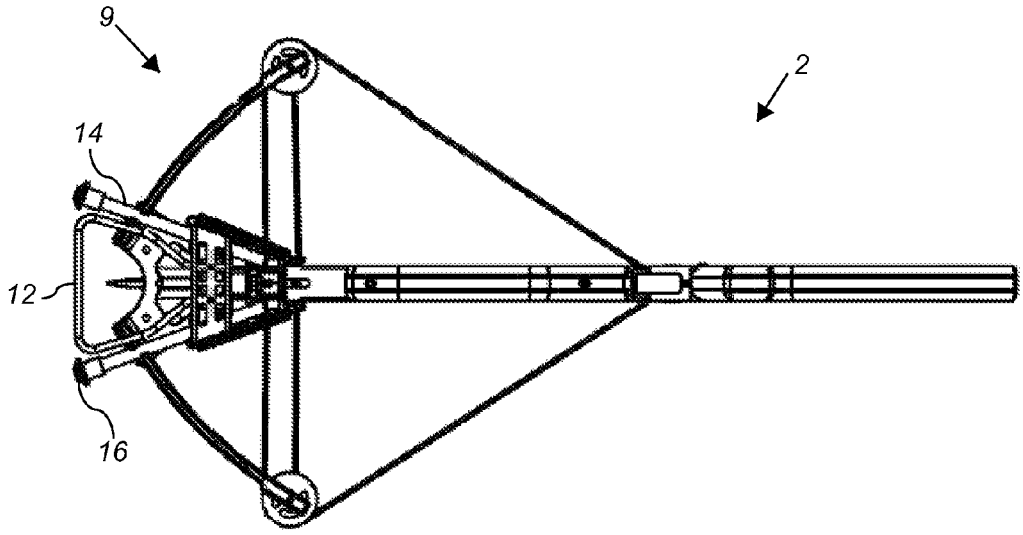
FIG. 5 is a bottom plan view thereof.

The kickstand 4 is activated by pressing the feet 16 of the legs 14 of the kickstand against the ground and applying pressure downwards on the legs. If the legs are initially in a closed and stored position as shown in FIGS. 3-5, doing this will move the legs 14 outwards away from the crossbow body and into a kickstand position as shown in FIGS. 1 and 2. In this position, the crossbow is balanced on the ground between the two stand legs and the stirrup of the crossbow. This allows the user to place the crossbow on the ground with one hand so that the user doesn't have to hold it at all times, while providing for a quick way for the user to pick up the crossbow with one hand and be ready to fire quickly.

Figure 6:
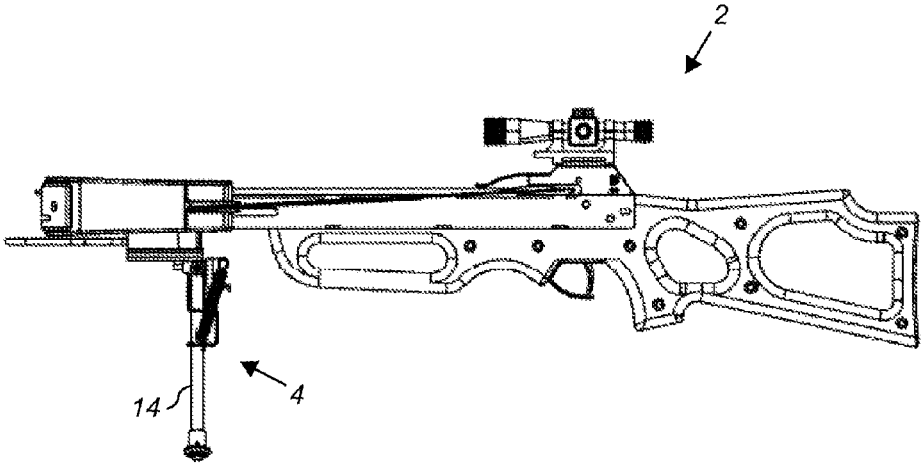
FIG. 6 is a side elevational view of the preferred embodiment of the present invention of FIG. 1 showing a bipod position.

FIG. 6 shows the kickstand 4 in a third, bipod position while attached to the crossbow 2. This is the position used for firing the crossbow and allows the crossbow to be tilted or moved to track a target. The bipod provides superior stability when using the crossbow for sport.

Figure 7A:
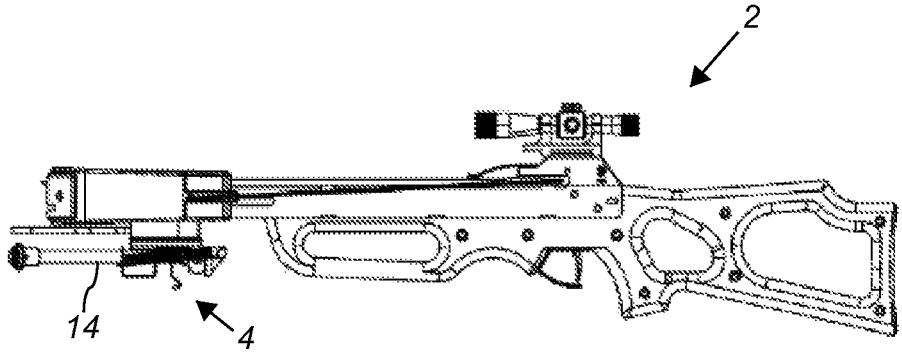
FIG. 7A is another side elevational view of the preferred embodiment of the present invention in a typical environment affixed to a crossbow and placed in a closed and stored position.
Figure 7B:
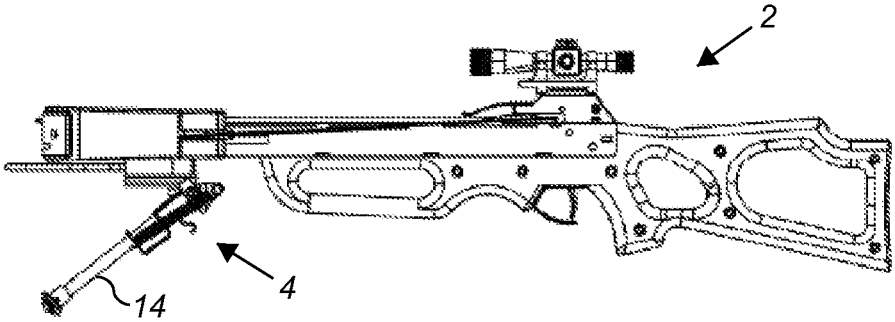
FIG. 7B is a side elevational view showing the progression from the closed and stored position of FIG. 7A to a kickstand position.
Figure 7C:
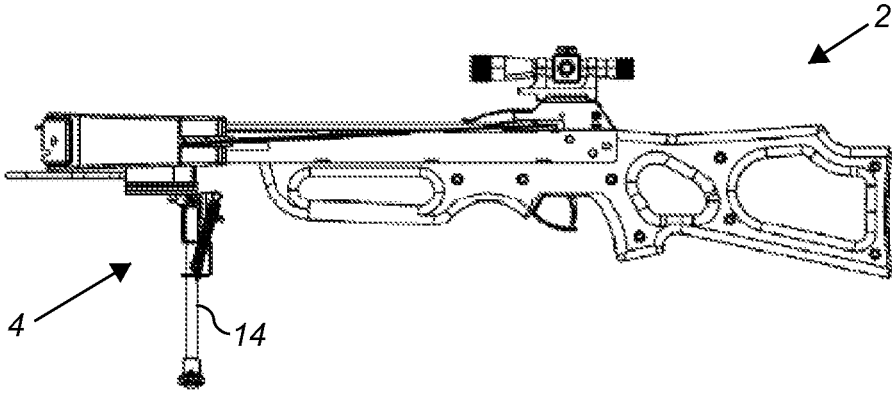
FIG. 7C is a side elevational view showing the progression from the kickstand position of FIG. 7B to a bipod position.

FIGS. 7A-7C show how the crossbow transitions between the three positions of the kickstand 4, from a closed and stored position in FIG. 7A, to a kickstand position in FIG. 7B for placing the crossbow upright on the ground, to the bipod position in FIG. 7C for accurate firing of the crossbow.

Figure 8:
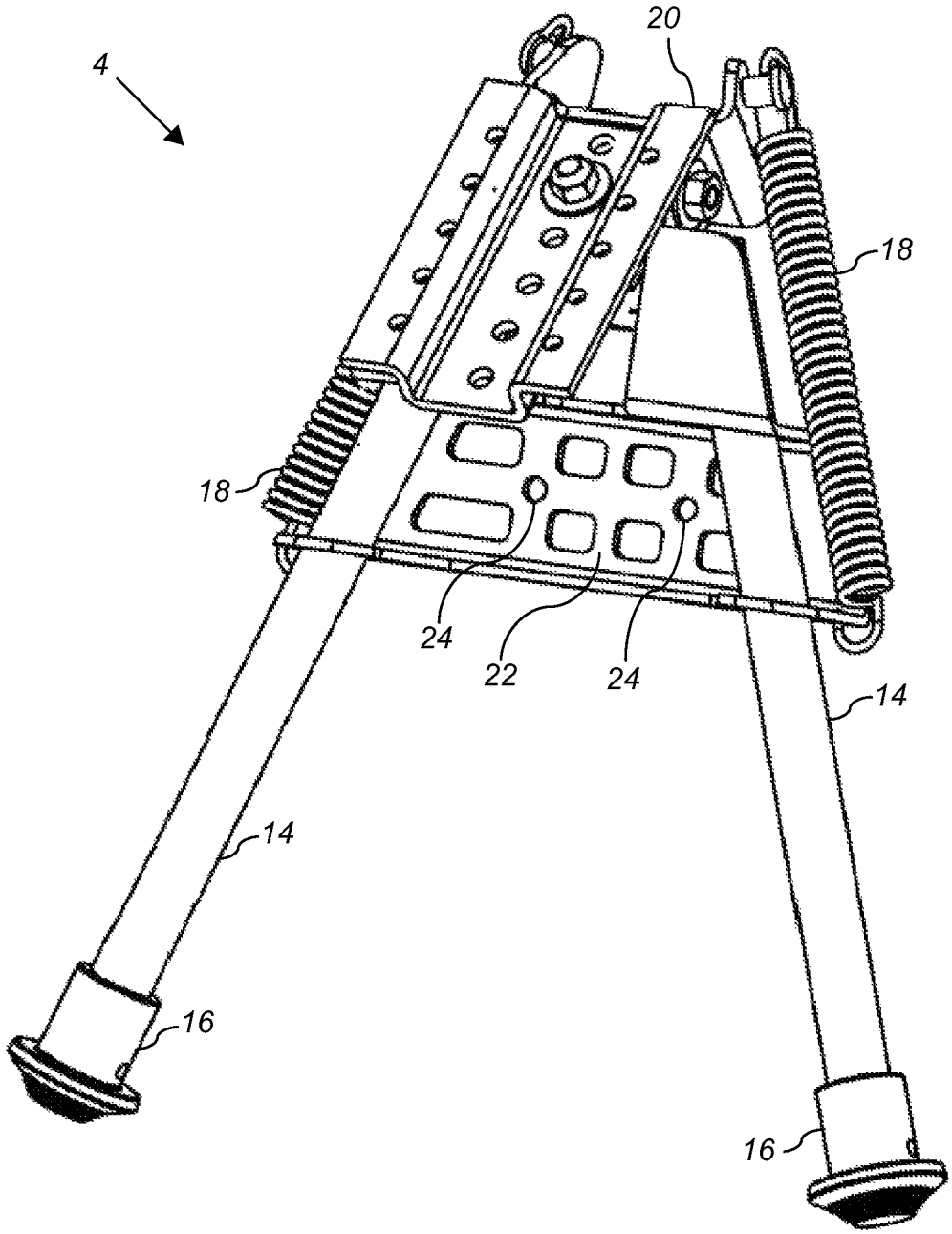
FIG. 8 is an isometric view of a preferred embodiment of the present invention.

FIGS. 8-13 show more detail of the kickstand 4 itself. As shown in FIG. 8, the kickstand 4 primarily consists of a pair of legs 4 hingedly connected to a mounting bracket 20 which is used to mount the kickstand assembly to the underside of the crossbow 2. A pair of springs 18 provides tension to the legs which allows the legs to retract back into the closed and stored position. A second mounting plate 22 includes mounting holes 24 for receiving a bolt quiver for storing additional crossbow bolts. The legs end in feet 16 which provide grip against the ground and prevent damage to the ends of the legs 14.

Figure 9:
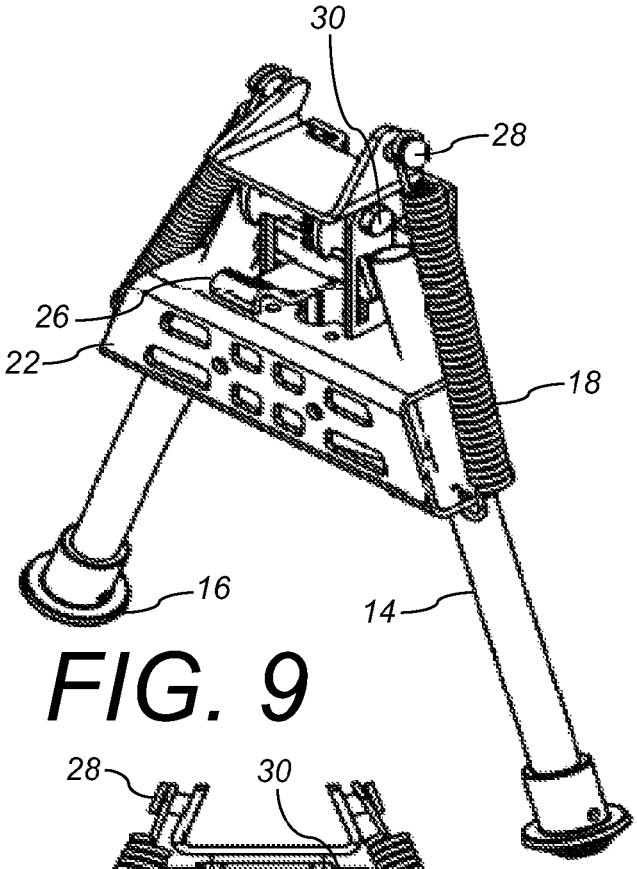
FIG. 9 is an alternative isometric view thereof.
Figure 10:
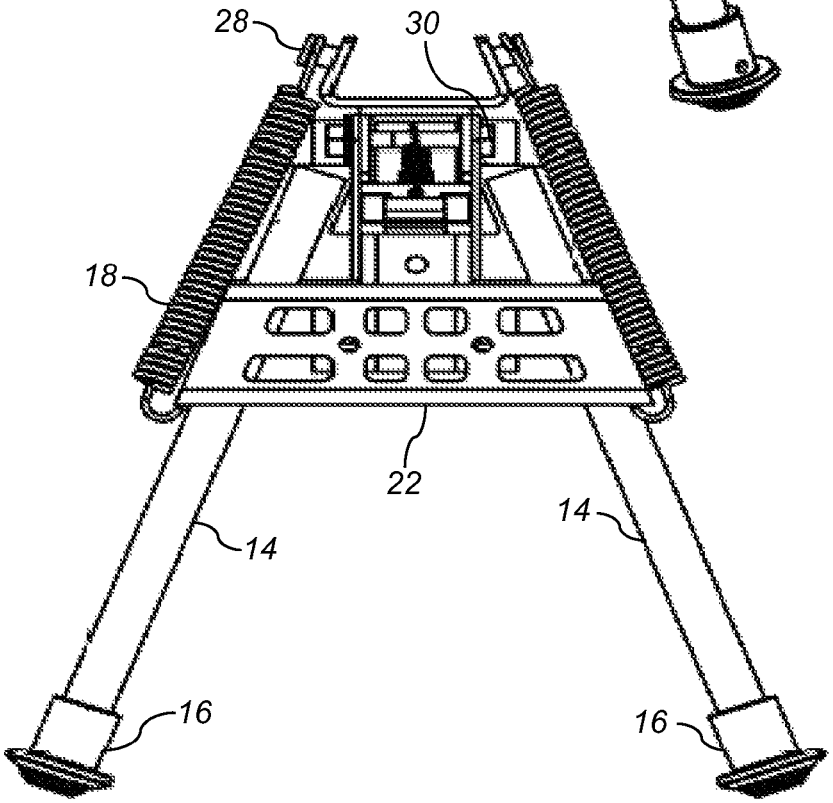
FIG. 10 is a top plan view thereof.
Figure 11:
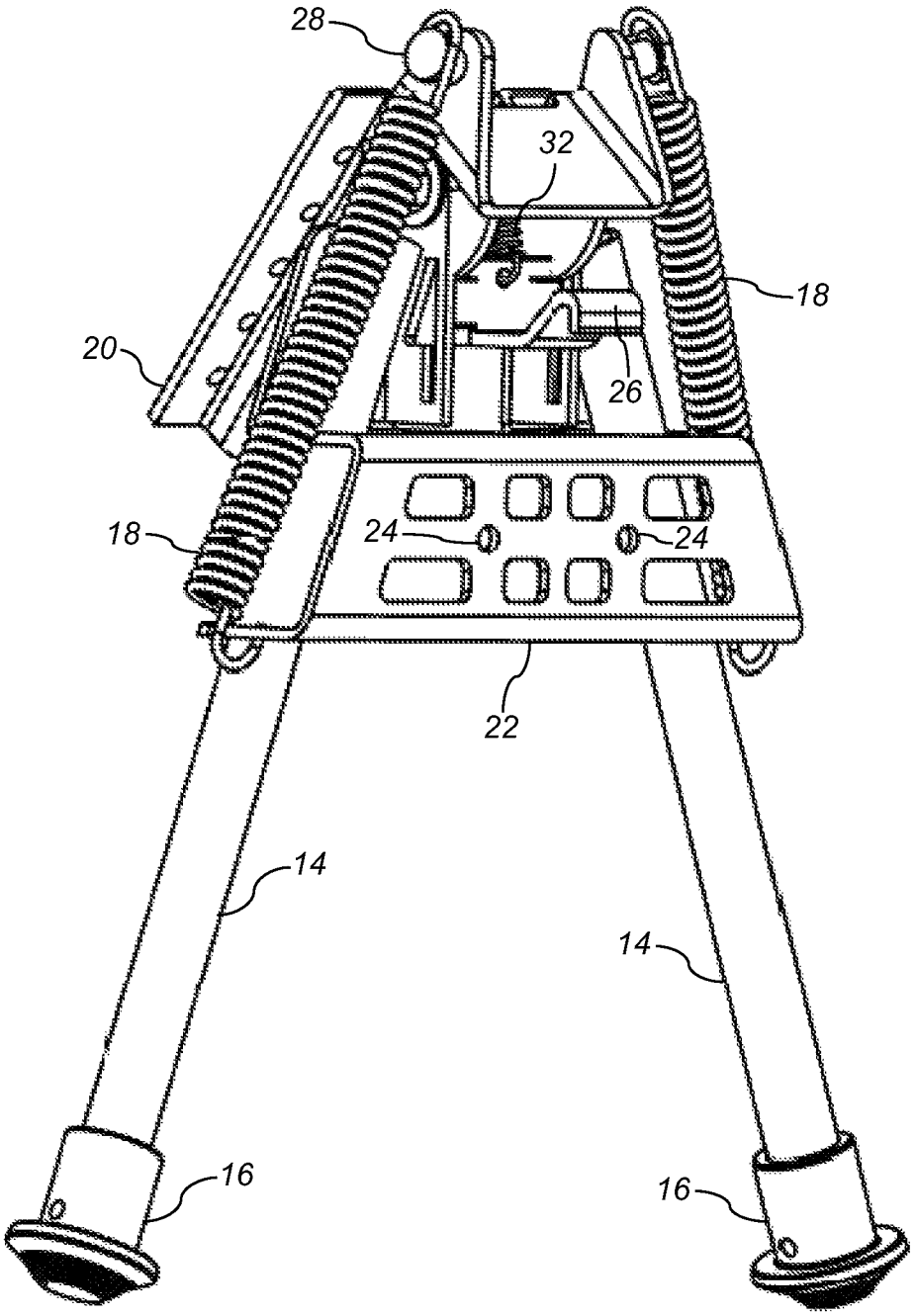
FIG. 11 is an alternative isometric view thereof.
Figure 12:
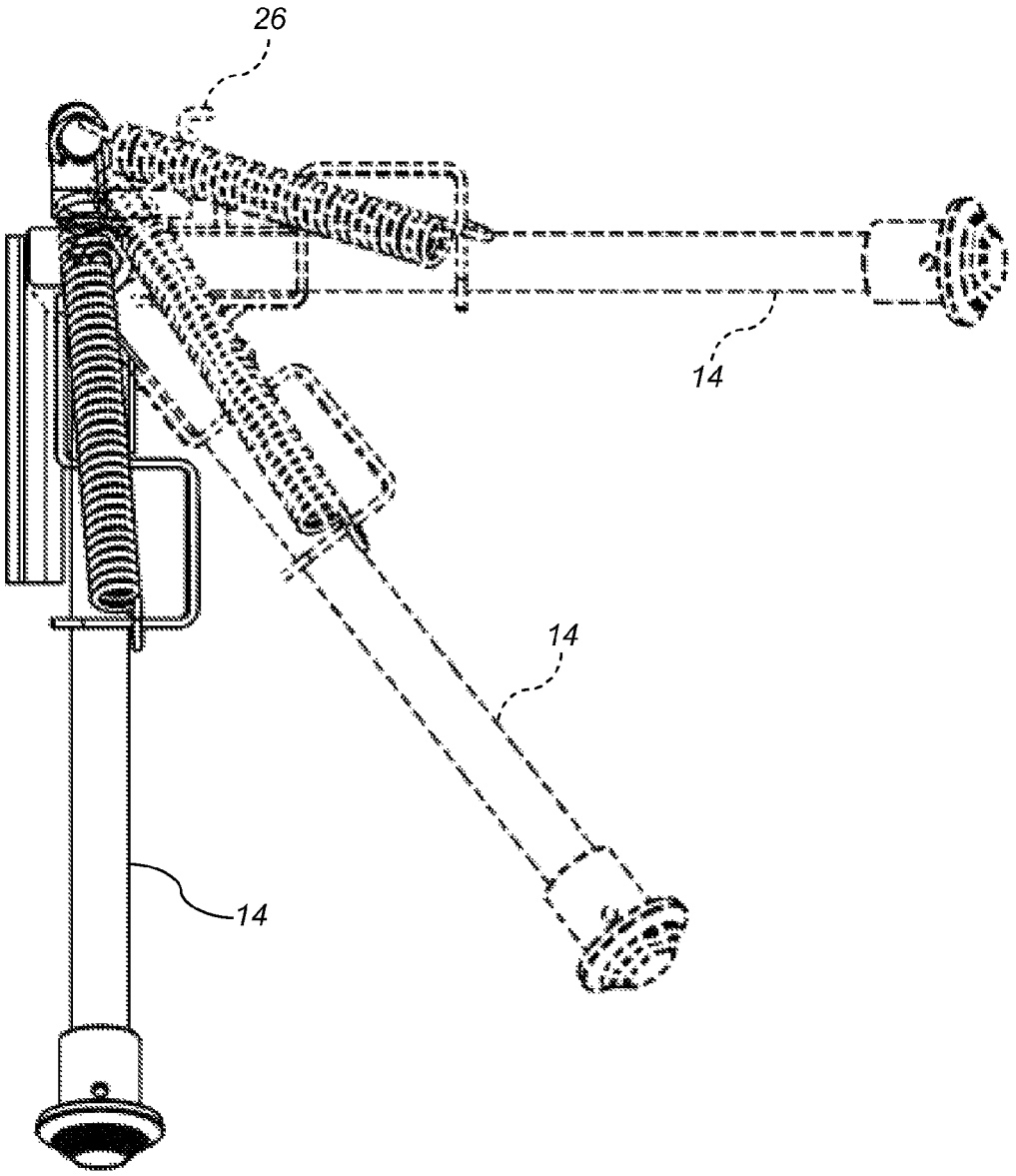
FIG. 12 is a side elevational view thereof, showing the progression of the invention from a closed and stored position to a kickstand position to a bipod position.
Figure 13:
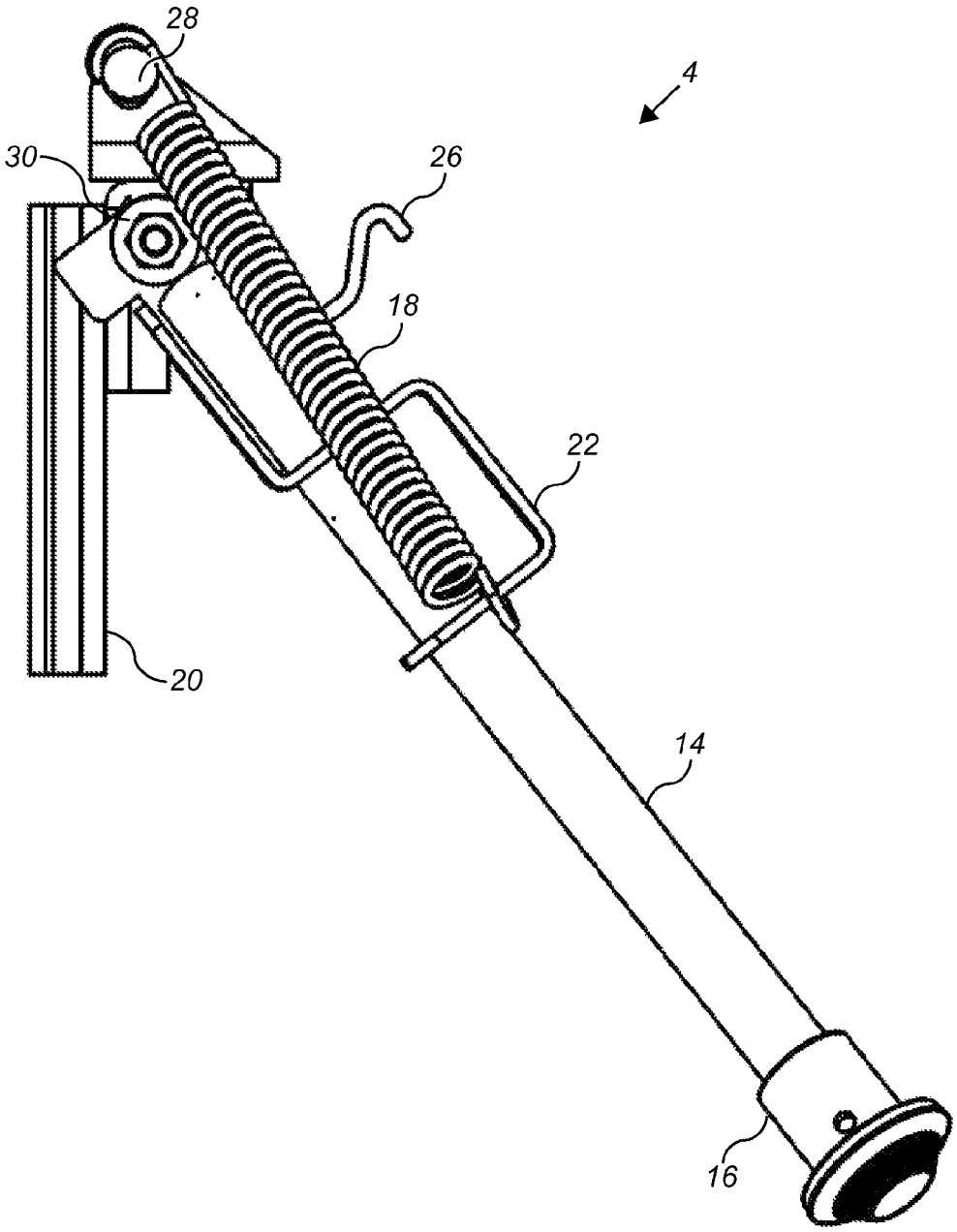
FIG. 13 is a side elevational view showing the present invention in a kickstand position.

FIG. 9 shows the hinge 30 which allows the legs 14 to pivot about the mounting plate 20. A finger tap 26 allows the user to quickly and easily release the kickstand 4 from the bipod position. For example, if the user places the crossbow against the ground and presses against the legs 14 to move the kickstand from the closed position to the kickstand position, the kickstand will stay in the kickstand position until the finger tap is activated, moving the kickstand to the bipod position. If the finger tap is activated, the springs 18 connected to the legs 14 and spring receivers 28 will draw the legs back into the bipod position. If the finger tap is activated when the unit is in the kickstand or bipod position the unit can be closed by pushing the kickstand forward toward the closed position, where the springs 18 will hold the legs 14 in the closed position. As shown in FIG. 11, the tap 26 activates an internal spring 32 which unlocks the legs and allows the leg springs 18 to withdraw the legs towards into the bipod position. Alternatively, a button or switch could be used instead of the finger tap. What is needed is a release mechanism that can quickly be used with one free hand.

The springs 18 hold the assembly closed; however, once the assembly is transferred to the kickstand position, the springs pull the entire assembly toward the bipod position. Tabs hold the assembly in the kickstand position, and the legs 14 may be repositioned to the closed position without using the finger tap 26 simply by pushing the legs into the closed position, either by hand or by pressing the legs against the ground. If the finger tap 26 is activated while the assembly is in the kickstand position, the legs 14 will be pulled by the springs 18 into the bipod position. The finger tap 26 is again used to reposition the assembly from the bipod position into the kickstand or closed position(s).

III. Alternative Embodiment Crossbow Assembly

Alternative to the separate attachable bipod element disclosed in detail above, the three-position kickstand could be built directly into the foregrip 11 portion of the crossbow 2. The invention would function fundamentally the same, but would be part of the physical structure of the crossbow itself rather than a separate unit that is attached to an existing crossbow.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A crossbow kickstand assembly comprising:

a pair of legs pivotally affixed to a base assembly, each of said legs terminating into a respective foot, wherein each said foot is configured to provide gripping resistance against a mounting surface;

said base assembly including a mounting bracket configured to attach to a crossbow body;

a pair of springs, each spring connected from said base assembly to a respective one of said pair of legs;

a finger tap;

a hinge bolt pivotally mounting said pair of legs to said base assembly;

said legs configured to lay flush against said base assembly and said crossbow body in a first, stored position;

said legs configured to pivot about said hinge bolt away from said base assembly to a second, kickstand position;

said finger tap configured to prevent said legs from pivoting further than said second, kickstand position;

said finger tap configured to be activated, thereby allowing said springs to pull said legs to a third, bipod position generally perpendicular to said base assembly and said crossbow body; and said finger tap further configured to be activated, thereby allowing said legs to be pivoted from said third, bipod position to either said first, stored position or to said second, kickstand position.

2. The kickstand assembly of claim 1 further comprising:

a quiver mounting plate affixed to said pair of legs, thereby spanning said legs; and a pair of quiver mounting holes configured to receive mounting bolts for mounting a quiver to said mounting plate.

3. The kickstand assembly of claim 1, further comprising:

a first tab configured to lock said legs from pivoting past said second, kickstand position; and wherein said first tab is activated via said finger tap.

4. The kickstand assembly of claim 1, further comprising an internal spring connected to said finger tap, wherein said internal spring is configured to return said finger tap to a resting position after said finger tap is released.

5. The kickstand assembly of claim 1, wherein said legs are positioned such as to form a 35 degree to 45 degree angle between said legs and said base assembly while said kickstand assembly is placed in said second, kickstand position.

6. A crossbow system comprising:

a crossbow including a stock, a stirrup, and a foregrip;

a kickstand assembly including a base assembly, a mounting bracket, a pair of legs, each leg terminating into a respective foot, and a pair of springs, each spring connecting from said base assembly to a respective one of said pair of legs;

said kickstand assembly mounted to said crossbow via said mounting bracket, wherein said mounting bracket is placed beneath said stock in proximity to said stirrup and in front of said foregrip;

a hinge bolt pivotally mounting said pair of legs to said base assembly;

said legs configured to lay flush against said base assembly and said crossbow body in a first, stored position;

said legs configured to pivot about said hinge bolt away from said base assembly to a second, kickstand position, wherein said two legs and said stirrup produce a three-point kickstand; and said springs configured to pull said legs to a third, bipod position generally perpendicular to said base assembly and said crossbow body.

7. The system of claim 6, further comprising:

a finger tap connected to said mounting assembly;

said finger tap configured to prevent said legs from pivoting further than said second, kickstand position; and said finger tap further configured to be activated, thereby allowing said legs to be pivoted from said third, bipod position to either said first, stored position or to said second, kickstand position.

8. The system of claim 7, further comprising:

a first tab configured to lock said legs from pivoting past said second, kickstand position; and wherein said first tab is activated via said finger tap.

9. The kickstand assembly of claim 7, further comprising an internal spring connected to said finger tap, wherein said internal spring is configured to return said finger tap to a resting position after said finger tap is released.

10. The kickstand assembly of claim 6, wherein said legs are positioned such as to form a 35 degree to 45 degree angle between said legs and said base assembly while said kickstand assembly is placed in said second, kickstand position.

11. A crossbow system comprising:

a crossbow including a stock, a stirrup, and a foregrip;

a kickstand assembly located within said stock, said kickstand assembly including a base assembly pair of legs, each leg terminating into a respective foot, and a pair of springs, each spring connecting from said base assembly to a respective one of said pair of legs;

said kickstand assembly located in proximity to said stirrup and in front of said foregrip;

a hinge bolt pivotally mounting said pair of legs to said base assembly;

said legs configured to lay flush against said base assembly and said crossbow body in a first, stored position;

said legs configured to pivot about said hinge bolt away from said base assembly to a second, kickstand position, wherein said two legs and said stirrup produce a three-point kickstand; and said springs configured to pull said legs to a third, bipod position generally perpendicular to said base assembly and said crossbow body.

12. The system of claim 11, further comprising:

a finger tap connected to said mounting assembly;

said finger tap configured to prevent said legs from pivoting further than said second, kickstand position; and said finger tap further configured to be activated, thereby allowing said legs to be pivoted from said third, bipod position to either said first, stored position or to said second, kickstand position.

13. The system of claim 12, further comprising:

a first tab configured to lock said legs from pivoting past said second, kickstand position; and wherein said first tab is activated via said finger tap.

14. The kickstand assembly of claim 12, further comprising an internal spring connected to said finger tap, wherein said internal spring is configured to return said finger tap to a resting position after said finger tap is released.

15. The kickstand assembly of claim 11, wherein said legs are positioned such as to form a 35 degree to 45 degree angle between said legs and said base assembly while said kickstand assembly is placed in said second, kickstand position.

* * * * *